US008764486B2

(12) United States Patent
Ii

(10) Patent No.: US 8,764,486 B2
(45) Date of Patent: Jul. 1, 2014

(54) SHIELDED CONNECTOR AND METHOD FOR ASSEMBLING THE SHIELDED CONNECTOR

(75) Inventor: Ryosuke Ii, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 58 days.

(21) Appl. No.: 13/550,633

(22) Filed: Jul. 17, 2012

(65) Prior Publication Data

US 2013/0023154 A1 Jan. 24, 2013

(30) Foreign Application Priority Data

Jul. 19, 2011 (JP) ..... 2011-158289

(51) Int. Cl.
*H01R 13/648* (2006.01)

(52) U.S. Cl.
USPC ..... 439/607.46

(58) Field of Classification Search
USPC ..... 439/607.46, 607.52, 660, 701, 712
See application file for complete search history.

(56) References Cited

U.S. PATENT DOCUMENTS

| | | | | |
|---|---|---|---|---|
| 6,210,229 | B1 * | 4/2001 | Lai | 439/607.52 |
| 7,192,313 | B2 * | 3/2007 | Sai | 439/660 |
| 7,661,987 | B2 * | 2/2010 | Adachi et al. | 439/595 |
| 7,695,318 | B1 * | 4/2010 | Wang et al. | 439/607.01 |
| 7,717,733 | B1 * | 5/2010 | Yi et al. | 439/452 |
| 7,896,559 | B2 * | 3/2011 | Yi et al. | 385/75 |
| 8,011,968 | B2 * | 9/2011 | Lai et al. | 439/660 |
| 8,353,724 | B2 * | 1/2013 | Shi et al. | 439/625 |
| 8,430,692 | B2 * | 4/2013 | Peng et al. | 439/607.46 |
| 8,550,828 | B2 * | 10/2013 | Liao et al. | 439/131 |
| 2013/0023155 | A1 * | 1/2013 | Ii | 439/607.27 |

FOREIGN PATENT DOCUMENTS

| | | |
|---|---|---|
| JP | 2003-173828 | 6/2003 |

* cited by examiner

*Primary Examiner* — Alexander Gilman
(74) *Attorney, Agent, or Firm* — Banner & Witcoff, Ltd.

(57) ABSTRACT

A shielded connector includes an inner housing that has a plurality of terminal accommodating chambers into which terminals which are crimped to ends of a plurality of shielded wires of a shielded electric wire are inserted, and a shield shell that includes a shield part which covers the inner housing and a barrel part which fixes a sheath part of the shielded electric wire. The inner housing has divided constructions into which the terminals can be inserted for each of a plurality of terminal groups.

8 Claims, 5 Drawing Sheets

SHIELDED CONNECTOR AND METHOD FOR ASSEMBLING THE SHIELDED CONNECTOR

BACKGROUND

The present disclosure relates to a shielded connector and a method for assembling the shielded connector.

A shielded connector is known which is connected to a multi-stranded shielded cable which has a plurality of signal lines in which conductors in which a plurality of wires are twisted are covered with insulative sheath layers (for example, refer to JP-A-2003-173828).

A shielded connector 501 of this kind at a cable side is shown in FIG. 6.

A shielded cable (shielded electric wire) 510 is formed by covering with an insulative outer sheath 514 the periphery of a metal foil 503 which covers signal lines 511 in each of which the periphery of a conductor 511*a*, which is formed by twisting a plurality of wires, is covered with an insulative coating layer 511*b*, and a drain line 512 which is formed by twisting a plurality of copper wires.

In the shielded connector 501, the signal lines 511 and the drain line 512 are exposed at the ends of the shielded cable 510, these ends are respectively connected to terminals 520, these terminals 520 are accommodated in terminal accommodating parts 531 of a dielectric (inner housing) 530, and a metal outer conductor shell 540, which is electrically connected with the terminal 520 which is located in the center and connected to the drain line 512, is installed to the periphery of the dielectric 530.

As shown in FIG. 7, a special shielded electric wire 603 is used as the shield electric wire of USB 2.0 (differential connector for high speed transmission), to have satisfactory transmission performance and noise-resistant performance. In order to make the shielded electric wire 603 have a structure that has satisfactory performance alone, it is necessary to strip the shielded electric wire 603 of a coating 629 such as an insulative outer sheath part 615 or a shield foil 627 at a connecting region with terminals 605. Thus, because the part where the coating 629 is striped may cause an impedance mismatch and make the transmission performance worse, it is preferred to make the part where the coating 629 is striped as short as possible.

However, if the part where the coating 629 of the shielded electric wire 603 is striped is shortened, when terminal installing shielded electric wires 607, in which the terminals 605 are crimped to the shielded electric wire 603, are inserted into an inner housing 609, it becomes necessary to adjust the directions of the terminals 605 and insert all (in the case of USB 2.0, four) of the terminal installing shielded electric wires 607 at the same time, or to intentionally arrange the terminal installing shielded electric wires 607 once in a half insertion state. The operation of inserting at the same time or the operation of arranging in a half insertion state makes the assembly of the terminals 605 to the inner housing 609 inefficient.

SUMMARY

The present disclosure is made in view of the above situation, and the object of the invention is to provide a shielded connector and an assembling method of the shielded connector so that the operation of inserting terminals becomes easy even when the part where the skin of a shielded electric wire is striped is shortened.

The above purpose of the invention is achieved with the following structures.

(1) There is provided a shielded connector comprising:

an inner housing that has a plurality of terminal accommodating chambers into which terminals which are crimped to ends of a plurality of shielded wires of a shielded electric wire are inserted; and a shield shell that includes a shield part which covers the inner housing and a barrel part which fixes a sheath part of the shielded electric wire, wherein the inner housing has divided constructions into which the terminals can be inserted for each of a plurality of terminal groups.

According to the shielded connector of the structure of the above (1), because the inner housing is divided, the plurality of terminals to which the shielded electric wires are respectively crimped can be inserted into the inner housings for each of the terminal groups the number of whose terminals is smaller. Therefore, even when the part where the skin of the shielded electric wires is striped is shortened and the stiffness of the connecting part of the terminal installing shielded electric wires is high, because the insertion direction to the inner housing can be changed for each of the small divided terminal groups, and the interference between the terminal installing shielded electric wires may not easily occur, the operation of inserting the terminals becomes easy.

(2) For example, a terminal insertion side part of the inner housing which configures a part of the plurality of terminal accommodating chambers is one of two divided constructions.

According to the shielded connector of the structure of the above (2), because the terminals can be inserted into some terminal accommodating chambers when the terminal insertion side part is in an open state, it is not necessary to insert all terminals at the same time, and the operation of inserting the terminals becomes easy.

For example, the inner housing includes a first inner housing portion having a part of the terminal accommodating chambers and a second inner housing portion having a remain part of the terminal accommodating chambers, engaging units are provided on a lower face of the first inner housing portion and an upper face of the second inner housing portion respectively, and the first inner housing portion is engaged with the second inner housing portion by the engaging units.

For example, the inner housing includes a first inner housing portion having only terminal insertion side part of a part of the terminal accommodating chambers and a second inner housing portion having a part other than the terminal insertion side part of the part of the terminal accommodating chambers and a remain part of the terminal accommodating chambers, and the first inner housing portion is attached to the second inner housing portion.

According to the present disclosure, there is also provided a method for assembling a shielded connector, comprising:

crimping terminals to ends of a plurality of shielded wires of a shielded electric wire;

inserting the terminals respectively into terminal accommodating chambers of a plurality of inner housings for each of a plurality of terminal groups;

uniting the plurality of inner housing to each other after the inserting process of the terminals;

attaching the united inner housings to a shield part of a shield shell; and fixing a sheath part of the shielded electric wire with a barrel part of the shield shell.

According to the assembling method of the shielded connector of the above (5), the terminals of the terminal installing shielded electric wire which were inserted at one time conventionally are inserted by being divided into the terminal groups the number of whose terminals is smaller. With the terminal groups the number of whose terminals is smaller, the stiffness of the connecting part of the whole terminal groups is lowered. Further, compared with the integral inner housing in which a large number of terminal accommodating chambers are adjacent to each other, the inner housing is divided to the inner housings the number of whose terminal accommodating chambers is smaller. Thus, when the terminals are inserted into the plurality of terminal accommodating chambers, the interference between the terminal installing shielded electric wires may not easily occur, and the operation of inserting the terminals becomes easy.

According to the shielded connector of the present disclosure, because the terminals can be respectively inserted into the terminal accommodating chambers of the divided inner housings for each of the smaller number of terminal groups, the operation of inserting the terminals becomes easy even when the part where the skin of the shielded electric wire is striped is shortened.

According to the assembling method of the shielded connector of the present disclosure, the inner housings can be united and installed into the shield part of the shield shell after the terminals are inserted into the terminal accommodating chambers of the inner housings for each of the terminal groups the number of whose terminals is smaller. Thus, even when the part where the skin of the shielded electric wires is striped is shortened, the operation of inserting the terminals is easy.

The present disclosure has been briefly described above. Further, details of the invention will become more apparent after embodiments of the invention described below (hereinafter referred to as "embodiments") are read with reference to the accompanying figures.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

Below, a shielded connector according to an embodiment of the invention is explained with reference to the figures.

A shielded connector 11 according to the present embodiment can be preferably used as a shielded connector at the cable side of USB 2.0 (differential connector for high speed transmission).

Figure 1:
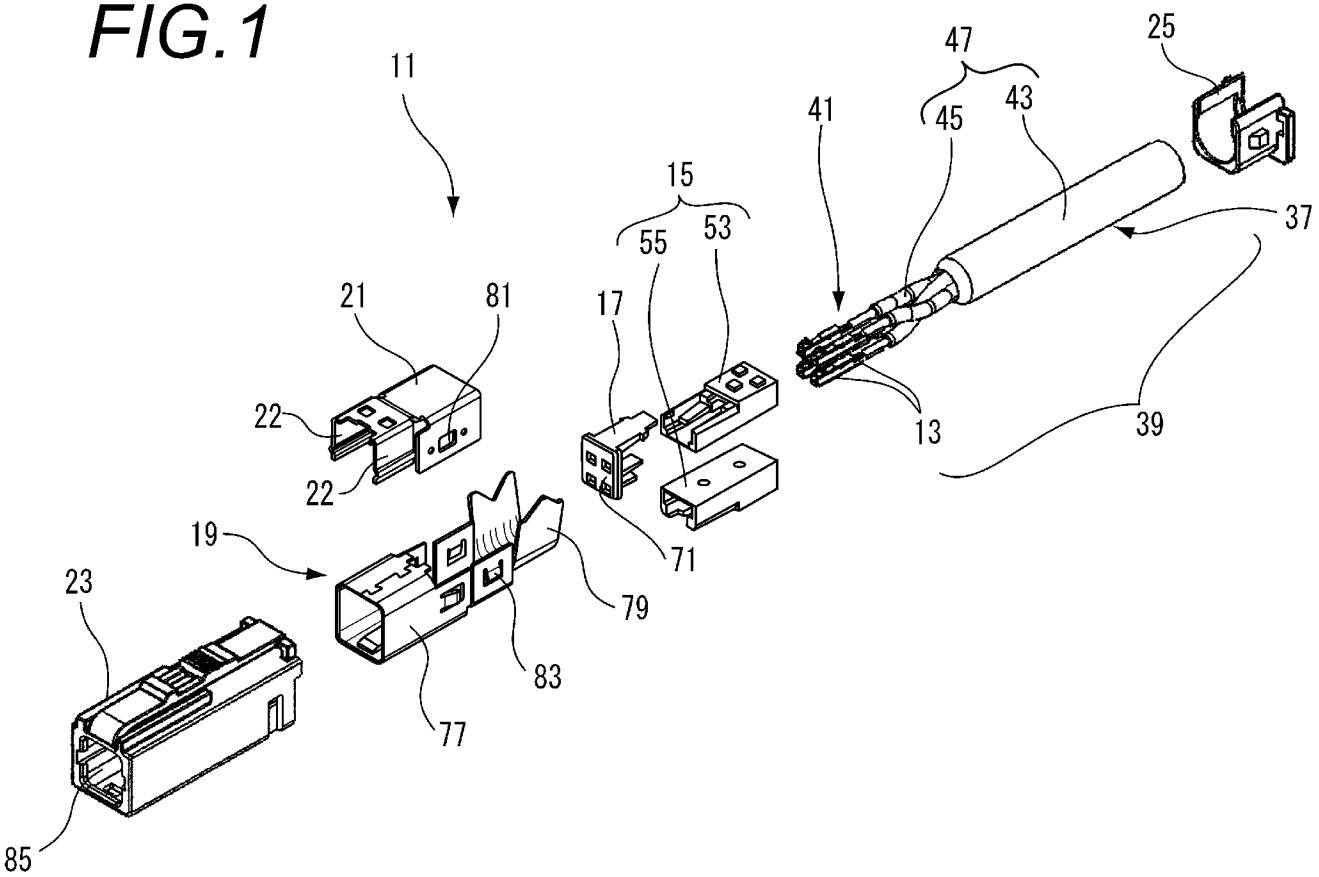
FIG. 1 is an exploded perspective view of a shielded connector according to one embodiment of the present disclosure.

As shown in FIG. 1, the shielded connector 11 includes terminals 13, an inner housing 15, a front folder 17, a shield shell 19, a shield shell cover 21, an outer housing 23 and a rear folder 25.

The terminals 13 are molded with sheet metal processing. In this embodiment, each of the terminals 13 is a female terminal which has a box-like electrical contact part 27 shown in FIG. 4. A contact strip 29 is formed inside the electrical contact part 27, and the contact strip 29 contacts with a board-like tab 31 of a mating male terminal shown in FIG. 5B. A terminal bent part 35 which a housing lance 33 to be described below locks is formed at the upper part of the electrical contact part 27. A terminal installing shielded electric wire 39 is formed when the terminals 13 are connected to a shielded electric wire 37.

It is necessary to strip the shielded electric wire 37 of the skin 47 of a sheath part 43 and a shield foil 45 at a connecting region 41 with the terminals 13. Because the part where the skin 47 is striped may cause an impedance mismatch and make the transmission performance worse, it is preferred to make the part where the skin 47 is striped as short as possible.

The inner housing 15 is molded of synthetic resin material. The inner housing 15 includes a plurality of terminal accommodating chambers 49 (refer to FIG. 4) into which the terminals 13, which are crimped to the ends of a plurality of shielded wires of the shielded electric wire 37, are inserted. The inner housing 15 has divided constructions into which the terminals 13 can be inserted for each of a plurality of terminal groups 51 shown in FIG. 2. A terminal group 51 means a plurality of terminals 13 which are inserted into the terminal accommodating chambers 49 almost at the same time from the same direction.

In this embodiment, the inner housing 15 is divided into two parts, that is, an upper inner housing 53 and a lower inner housing 55. A temporary fixing unit is provided on a joining surface 57 of the upper inner housing 53 and the lower inner housing 55 to hold the upper inner housing 53 and the lower inner housing 55 temporarily. Concave and convex engaging parts or a groove and a convex bar which are engaged with the groove or the like may be used as the temporary fixing unit. In the illustrated example, concave engaging parts 59 are formed on the top surface of the lower inner housing 55 and convex engaging parts not shown in the figure are formed on the bottom surface of the upper inner housing 53.

Figure 3:
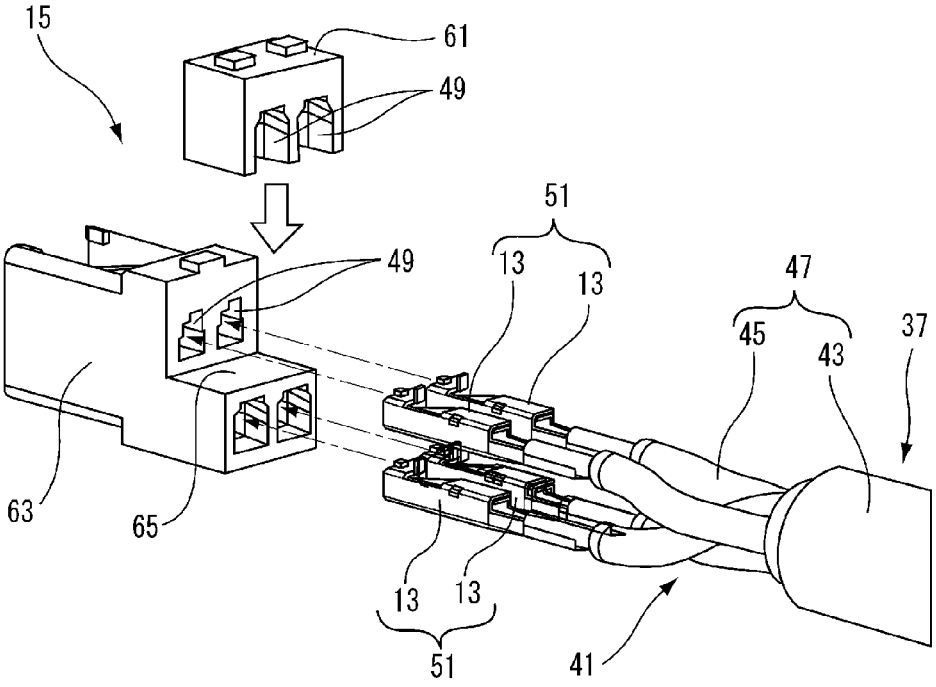
FIG. 3 is an enlarged perspective view of main parts which indicates a variation of the divided constructions of the inner housing shown in FIG. 2.

Besides, the divided constructions of the inner housing 15, as shown in FIG. 3, may be a terminal insertion side part 61 of the inner housing 15 which forms a part of the terminal accommodating chambers 49 in the plurality of the terminal accommodating chambers 49 as one of two divided constructions. In the illustrated example, a step-like inner housing 63 is formed and a step part 65 of the step-like inner housing 63 may hold the terminal insertion side part 61 which forms some terminal accommodating chambers 49. A temporary fixing unit can be used for temporarily fixing the step-like inner housing 63 and the terminal insertion side part 61.

According to the inner housing 15 having the divided constructions in this variation, because a part of the terminals 13 can be inserted into a part of the terminal accommodating chambers 49 when the terminal insertion side part 61 is in an open state (detached state), it is not necessary to insert all terminals 13 into all terminal accommodating chambers at the same time.

The terminals 13 are attached by being inserted into the terminal accommodating chambers 49 which are formed in the inner housing 15, respectively. The terminal accommodating chamber 49 communicates with a tab insertion opening 67 which opens in the front of the inner housing 15 shown in FIG. 4. The rear of the terminal accommodating chamber 49 opens at the rear part of the inner housing 15 as a terminal insertion opening 69. A cantilevered beam-like housing lance 33 is provided inside the terminal accommodating chamber 49. The housing lance 33 locks with the terminal bent part 35 of the terminal 13 which is inserted into the terminal accommodating chamber 49 from the rear in the terminal insertion direction so that the terminal 13 is fixed in the terminal accommodating chamber 49 by being regulated from dropping.

Figure 4:
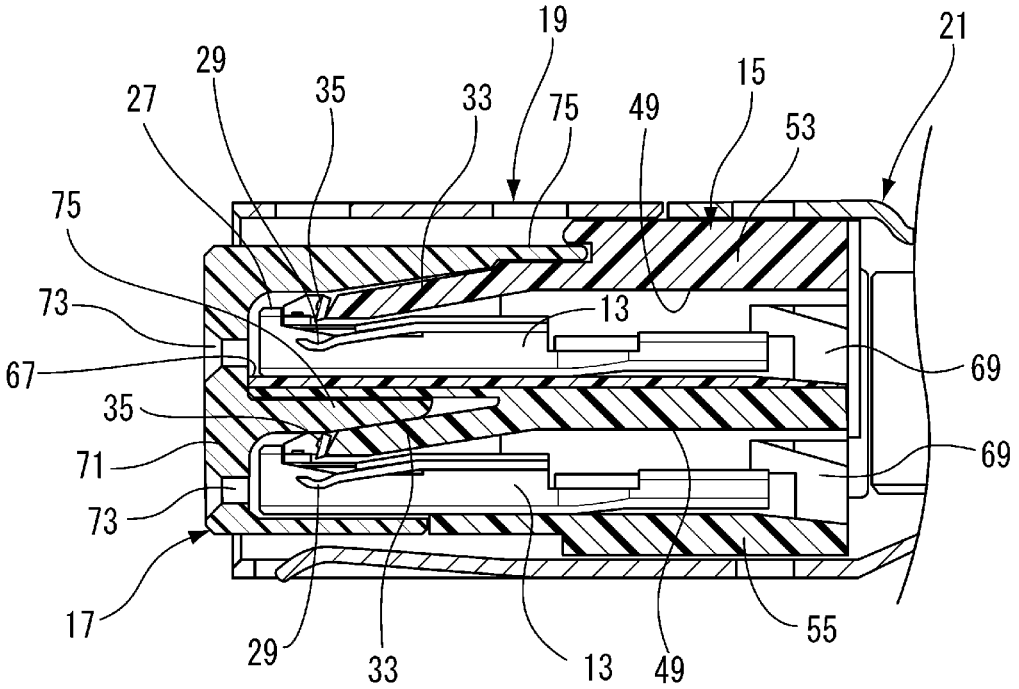
FIG. 4 is a longitudinal sectional view which shows that the inner housing is accommodated in a shield shell shown in FIG. 1.

The front folder 17 has a front plate 71 shown in FIG. 4, and is attached by being inserted into the front part of the inner housing 15. A plurality of windows 73 corresponding to the tab insertion openings 67 of the inner housing 15 are formed at the front plate 71. A plurality of lance regulating pieces 75 are protruded from the front plate 71, and the lance regulating pieces 75 are inserted into flexible spaces of the housing lances 33. When the lance regulating pieces 75 are inserted into the flexible spaces, the movement of the housing lances 33 in the unlocking direction is regulated, and the terminals 13 are dually locked.

The shield shell 19 shown in FIG. 1 is formed with sheet metal processing by using sheet metal materials. The shield shell 19 has a box-like shield part 77 which covers the inner housing 15 when the inner housing 15 is inserted inside. Behind the shield part 77, a barrel part 79 which crimps and fixes the sheath part 43 of the shielded electric wire 37 is adjacently provided. The inner housing 15, into which the terminals 13 of the terminal installing shielded electric wire 39 are attached by being inserted, is inserted into the shield shell 19, and the sheath part 43 of the terminal installing shielded electric wire 39 is caulked and fixed to the barrel part 79.

The shield shell cover 21 is installed to the shield shell 19 to cover the shield shell 19 from above. The shield shell cover 21 is fixed to the shield part 77 by locking holes 81 which are formed at two sides of the shield shell cover 21 to locking claws 83 which are formed at two sides of the shield part 77.

The outer housing 23 is molded of synthetic resin material into a rectangular pipe shape. A shell installing space 85 is formed inside the outer housing 23. The inner housing 15 which is covered by the shield shell 19 is inserted into the shell installing space 85. The rear folder 25 is locked in the shell installing space 85 at the rear part of the outer housing 23 which accommodates the inner housing 15. When the rear folder 25 is locked to the outer housing 23, the inner housing 15 is regulated from dropping, and the shielded electric wire 37 which is derived from the inner housing 15 is supported.

Figure 5A:
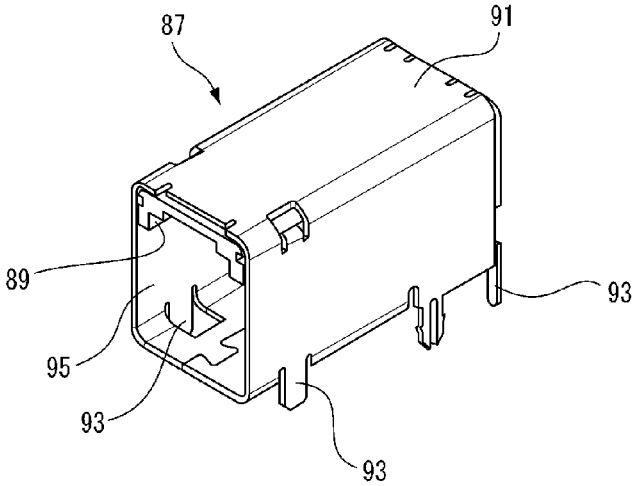
FIG. 5A is a perspective view of a mating connector.
Figure 5B:
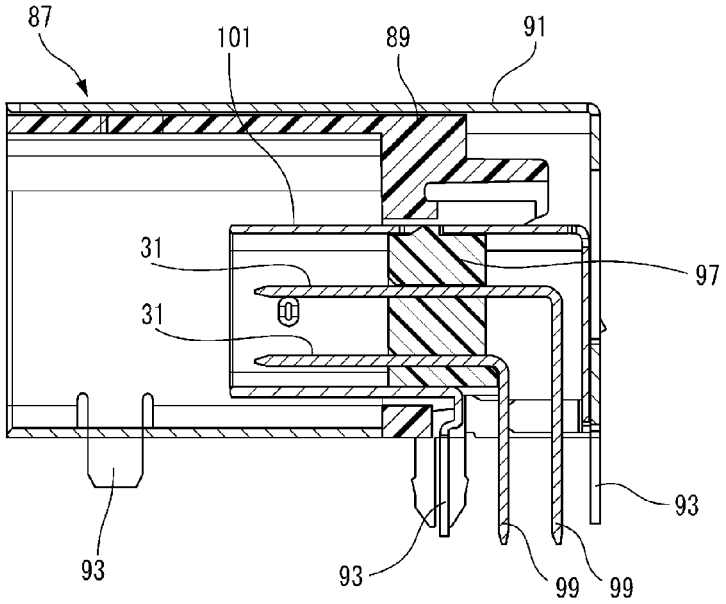
FIG. 5B is a sectional view of the mating connector shown in FIG. 5A.
Figure 6:
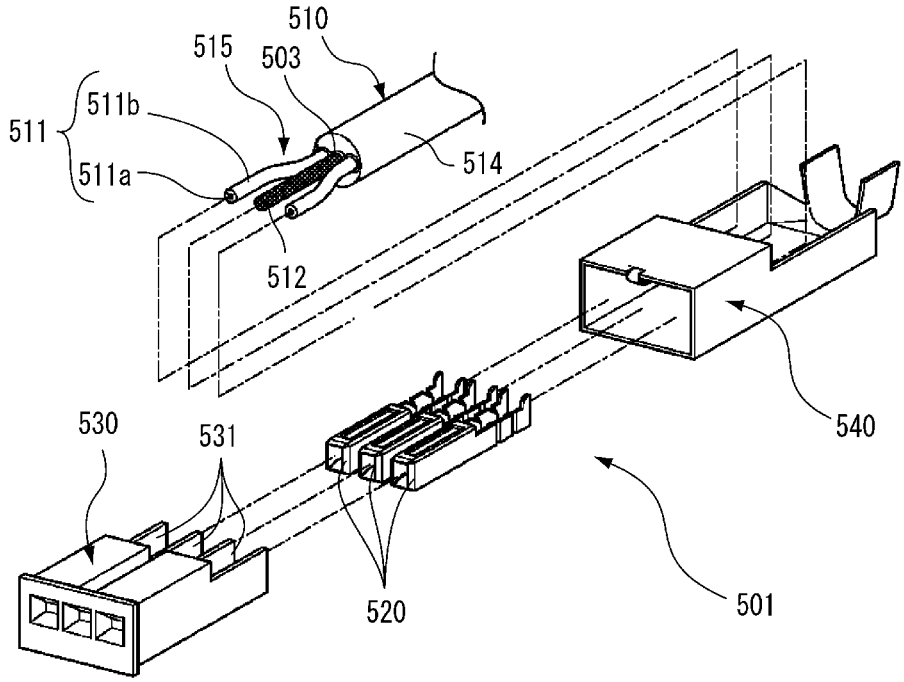
FIG. 6 is an exploded perspective view of a conventional shielded connector.

In a mating connector 87 shown in FIGS. 5A and 5B, the outside of a mating outer housing 89 is covered by an outer shield shell 91. Board connecting parts 93 are vertically provided at the outer shield shell 91, and the board connecting parts 93 are soldered to through holes which are formed on a board of an electronic device not shown in the figure and connected to the ground of the board at the same time. A connector fitting space 95 for receiving the shielded connector 11 is formed inside the mating outer housing 89. A mating inner housing 97 is provided in the connector fitting space 95, and the mating inner housing 97 accommodates the tabs 31 which are a plurality of mating male terminals. The tabs 31 are connected to a predetermined circuit when lead parts 99 of the tabs 31 are soldered to through holes of the board not shown in the figure. The tabs 31 will be connected to the terminals 13 of the shielded connector 11. The mating inner housing 97 is covered by a mating inner shell 101. Board connecting parts 93 are vertically provided at the mating inner shell 101, and the board connecting parts 93 are soldered to through holes which are formed on the board not shown in the figure and connected to the ground of the board at the same time.

Next, an assembling procedure of the shielded connector 11 having the above structure and the effects of the shielded connector 11 are described.

To assemble the shielded connector 11, as shown in FIG. 1, the terminals 13 are crimped and connected to the ends of the plurality of shielded wires of the shielded electric wire 37 to form the terminal installing shielded electric wire 39. The terminals 13 of the terminal installing shielded electric wire 39 are respectively inserted into the plurality of terminal accommodating chambers 49 of the upper inner housing 53 and the lower inner housing 55 which are the inner housings 15.

Then, the upper inner housing 53 and the lower inner housing 55 are united, and the front folder 17 is assembled from front. The inner housing 15 to which the front folder 17 was installed is installed into the shield part 77 of the shield shell 19. The sheath part 43 of the shielded electric wire 37, which is derived from the rear of the inner housing 15 which is attached by being inserted into the shield shell 19, is crimped and fixed with the barrel part 79 of the shield shell 19.

The shielded wire exposure part near the barrel part 79 is covered when the shield shell cover 21 is installed. Then, the shield shell 19 is attached by being inserted into the outer housing 23. Finally, when the rear folder 25 is locked to the outer housing 23 which accommodates the inner housing 15, the assembling of the shielded connector 11 is completed.

Figure 2:
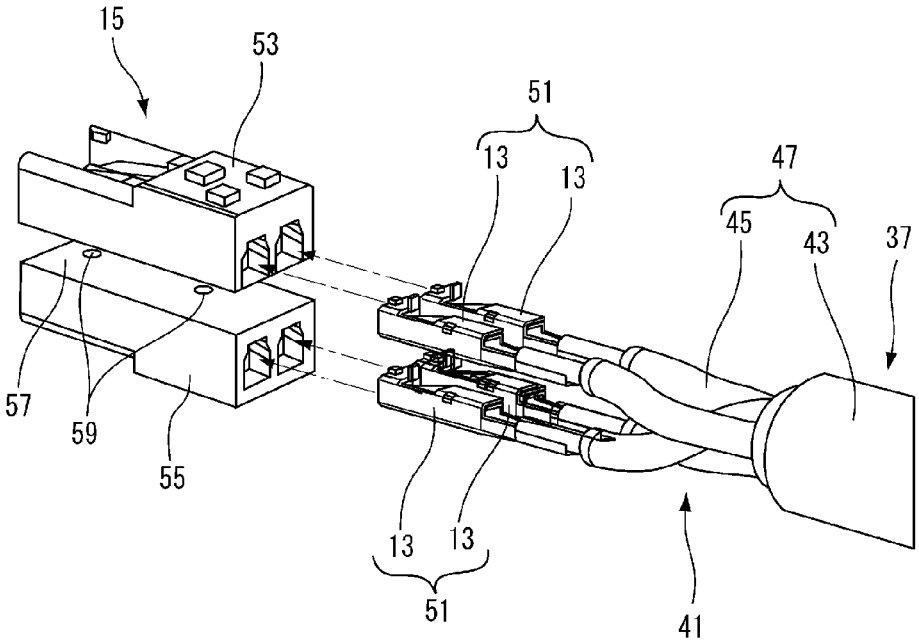
FIG. 2 is an enlarged perspective view of main parts of an inner housing shown in FIG. 1.
Figure 7:
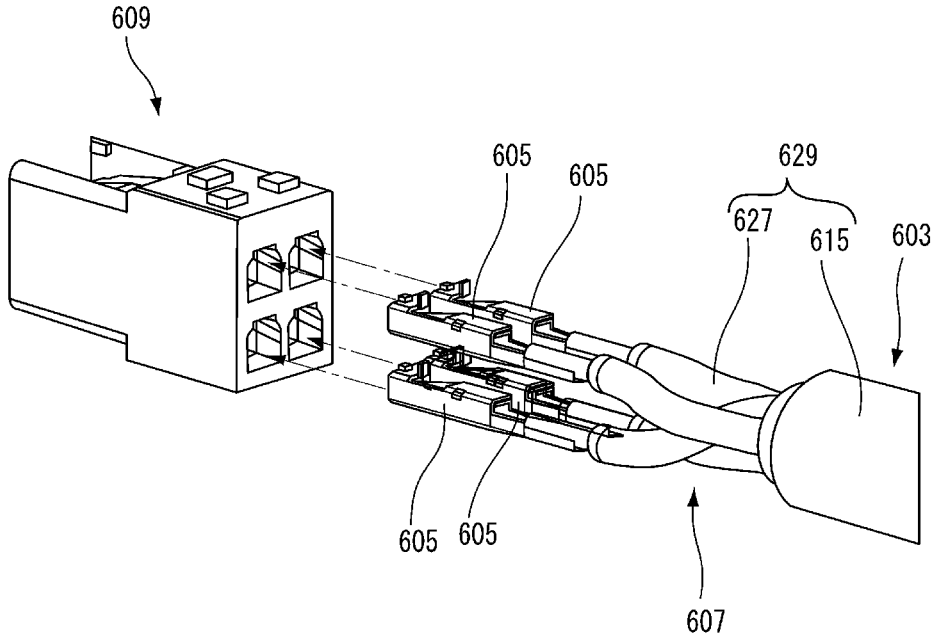
FIG. 7 is an exploded perspective view of main parts to describe the problems of the conventional shielded connector.

In a prior art, the terminals 13 of the terminal installing shielded electric wire 39 are inserted to the terminal accommodating chambers at one time. However, according to the assembling method of the shielded connector 11 of the present embodiment, the terminals 13 of the terminal installing shielded electric wire 39 can be inserted by being divided into the terminal groups 51 the number of whose terminals is smaller as shown in FIG. 2. With the terminal groups 51 the number of whose terminals is smaller, the stiffness of the connecting part 41 of the whole terminal groups is lowered. Further, compared with the integral inner housing 609 (refer to FIG. 7) in which a large number of the terminal accommodating chambers 49 are adjacent to each other, the inner housing 15 is divided to the upper inner housing 53 and the lower inner housing 55 the number of whose terminal accommodating chambers 49 is smaller. Thus, when the terminals are inserted into the plurality of terminal accommodating chambers 49, the interference between the terminal installing shielded electric wires 39 may not easily occur, and the operation of inserting the terminals becomes easy.

According to the shielded connector 11 of the present embodiment, because the inner housing 15 is divided, the plurality of terminals 13 to which the shielded electric wires 37 are respectively crimped can be inserted into the inner housings 15 for each of the terminal groups 51 the number of whose terminals is smaller. Therefore, even when the part where the skin 47 of the shielded electric wires 37 is striped is shortened and the stiffness of the connecting part 41 of the terminal installing shielded electric wires 39 is high, because the insertion direction to the inner housing 15 can be changed for each of the small divided terminal groups, and the interference between the terminal installing shielded electric wires 39 may not easily occur, the operation of inserting the terminals becomes easy.

The shielded connector and the assembling method of the shielded connector of the invention are not restricted to the above-described embodiments, and suitable modifications, improvements and the like can be made. Moreover, the materials, shapes, dimensions, numbers, installing places, and the like of the components in the above embodiments are arbitrarily set as far as the invention can be attained, and not particularly restricted.

The present application is based on Japanese Patent Application No. 2011-158289 filed on Jul. 19, 2011, the contents of which are incorporated herein by reference.

What is claimed is:

1. A shielded connector comprising:

an inner housing including a plurality of terminal accommodating chambers configured to receive a plurality of terminals which are crimped to ends of a plurality of shielded wires of a shielded electric wire, the inner housing including:

a first inner housing portion having a first portion of the plurality of terminal accommodating chambers and a first plurality of engaging units formed on a first surface of the first inner housing portion; and a second inner housing portion, separate from the first inner housing portion, the second inner housing portion including a second portion of the plurality of terminal accommodating chambers and a second plurality of engaging units corresponding to the first plurality of engaging units and formed on a second surface of the second inner housing portion, wherein the second plurality of engaging units is configured to engage the first plurality of engaging units when the second inner housing portion is connected to the first inner housing portion; and a shield shell including a shield part configured to cover the inner housing and a barrel part configured to connect to a sheath part of the shielded electric wire, wherein the first portion of the plurality of terminal accommodating chambers of the first inner housing portion is configured to receive at least one terminal of the plurality of terminals and the second portion of the plurality of terminal accommodating chambers of the second inner housing portion is configured to receive at least one other terminal of the plurality of terminals, different from the at least one terminal of the plurality of terminals.

2. The shielded connector according to claim 1, wherein the second inner housing portion includes a terminal insertion side part which includes the second portion of the plurality of terminal accommodating chambers.

3. The shielded connector according to claim 1, wherein the first plurality of engaging units includes one of concave engaging parts and convex engaging parts and the second plurality of engaging units includes the other of the concave engaging parts and the convex engaging parts.

4. The shielded connector of claim 1, wherein the first plurality of engaging units includes one of a groove and a convex bar and the second plurality of engaging units includes the other of the groove and the convex bar.

5. The shielded connector of claim 1, wherein the first plurality of engaging units includes concave engaging parts and the second plurality of engaging units includes convex engaging parts.

6. A method for assembling a shielded connector, comprising:

crimping a plurality of terminals to ends of a plurality of shielded wires of a shielded electric wire;

forming an inner housing having a plurality of terminal accommodating chambers, forming the inner housing including:

forming a first inner housing portion having a first portion of the plurality of terminal accommodating chambers;

forming a first plurality of engaging units on a first surface of the first inner housing portion;

forming a second inner housing portion, separate from the first inner housing portion, and including a second portion of the plurality of terminal accommodating chambers; and forming a second plurality of engaging units on a second surface of the second inner housing portion;

inserting the plurality of terminals respectively into the plurality of terminal accommodating chambers arranged in the first inner housing portion and the second inner housing portion, connecting the first inner housing portion to the second inner housing portion after the inserting of the terminals, the connecting the first inner housing portion to the second inner housing portion including engaging the first plurality of engaging units with the second plurality of engaging units;

connecting the connected first inner housings portion and the second inner housing portion to a shield part of a shield shell; and connecting a sheath part of the shielded electric wire with a barrel part of the shield shell.

7. The method of claim 6, wherein forming the first plurality of engaging units includes forming one of concave engaging parts and convex engaging parts, and forming the second plurality of engaging units includes forming the other of the concave engaging parts and convex engaging parts.

8. The method of claim 6, wherein forming the first plurality of engaging units includes forming one of a groove and a convex bar, and forming the second plurality of engaging units includes forming the other of the groove and the convex bar.

* * * * *